US005231806A

United States Patent [19]

Swain

[11] Patent Number: 5,231,806

[45] Date of Patent: Aug. 3, 1993

[54] AIR SWEEP SYSTEM FOR MOBILE SURFACE ABRADING APPARATUS

[76] Inventor: Jon M. Swain, 3145 Holloway Rd., Ruston, La. 71270

[21] Appl. No.: 923,467

[22] Filed: Aug. 3, 1992

Related U.S. Application Data

[63] Continuation-in-part of Ser. No. 649,737, Feb. 1, 1991, Pat. No. 5,161,337.

[51] Int. Cl.[5] ..... B24C 3/06

[52] U.S. Cl. ..... 51/429; 51/425

[58] Field of Search ..... 51/429, 424, 425, 410; 209/290, 291, 296

[56] References Cited

U.S. PATENT DOCUMENTS

| | | | |
|---|---|---|---|
| 3,392,491 | 7/1968 | Vogt | 51/424 |
| 3,934,372 | 1/1976 | Diehn et al. | 51/429 |
| 3,981,104 | 9/1976 | Dreher | 51/429 |
| 4,364,823 | 12/1982 | Goff | 51/429 |
| 4,433,511 | 2/1984 | Swain | 51/429 |
| 4,771,579 | 9/1988 | Giese | 51/425 |
| 4,841,681 | 6/1989 | Dickson | 51/429 |

FOREIGN PATENT DOCUMENTS

| | | | |
|---|---|---|---|
| 1518785 | 7/1978 | United Kingdom | 51/424 |
| 2203072 | 10/1988 | United Kingdom | 51/429 |

*Primary Examiner*—Robert A. Rose
*Attorney, Agent, or Firm*—John M. Harrison

[57] ABSTRACT

An air sweep system for a mobile surface abrading apparatus designed for cleaning and texturing the surface of horizontal, or near horizontal, structures, particularly roads, highways, airport runways and the like. Abrasive particles such as steel shot or grit are projected at the structure surface in angular relationship to abrade and etch the surface and the abrasive is swept by a current of air into one or more vertical abrasive conveyors, where it is transferred by air to a rotating screen, separated from the air, road debris and dust in the screen, recycled and repeatedly projected onto the surface to be treated. Air flow through a sweeper channel upwardly through the vertical abrasive conveyor(s) is carefully controlled to lift the abrasive particles, as well as the dust and debris, beyond the rebound energy boundary and effect efficient recycling of the particles.

20 Claims, 5 Drawing Sheets

AIR SWEEP SYSTEM FOR MOBILE SURFACE ABRADING APPARATUS

CROSS-REFERENCE TO RELATED APPLICATIONS

This application is a continuation-in-part of my copending U.S. patent application Ser. No. 07/649,737, filed Feb. 1, 1991 now U.S. Pat. No. 5,161,337.

BACKGROUND OF THE INVENTION

1. Field of the Invention

This invention relates to apparatus for treating horizontal structure surfaces, and more particularly, to an air sweep system for a mobile surface abrading apparatus which utilizes air circulation to recycle rebounding abrasive from the treated surface through a concentric dual rotating screen separation system and into a hopper, where it is fed to an abrasive propulsion device or devices, and where the abrasive media or particles are projected at the treated surface at high velocity in angular relationship. The rebounding abrasive particles and surface materials such as dust, aggregate and debris, are recovered from the treated surface by air flow through one or more vertical abrasive conveyors. The mobile surface abrading apparatus is capable of operating with one or more mechanical air-operated conveyance devices providing energy to the abrasive particles for transporting the abrasive particles and surface debris to the separation system.

This invention is characterized by a continuous air flow system and an improvement in the lifting of abrasive, aggregate and debris in a vertical or near-vertical direction with air movement alone, allowing one or more propulsion devices to treat a surface area adjacent to the air flow conveyor. The principle involves a selected air flow which is forced through restricted passages or channels, where particulate transfer is effected and non-restricted areas where separation of air and abrasive particles is accomplished. The abrading apparatus includes passages that allow abrasive and other particulate to be received from one or more angles, which facilitates an internal area of sufficient size to sustain an appropriate air velocity which forces the various particles to be encountered, both transversely in the sweeping function and upwardly in the conveying function, against the pull of gravity.

In the vertical conveying function, the maximum speed at which any object will fall is reached when atmospheric friction equals gravitational pull, and this speed is known as the terminal velocity. The air flow system of this invention is designed to slightly exceed this terminal velocity and thus convey the abrasive particles upwardly through the apparatus. The pneumatic conveyance of abrasive particles in the apparatus of this invention would not normally require dust-handing equipment. Nonetheless, the abrading operation is very dusty unless a dust collector is used and dust collection is mandated by environmental laws and common sense. Accordingly, a blower must be used to exhaust the cleaned air from the dust collector. This invention combines a dual purpose pressure blower that is properly sized for the volume and intensity necessary to satisfy the needs of the dust filters and the vertical abrasive and debris conveying chamber to recycle the spent abrasive particles.

Sweeping of the horizontal structure surface to be treated is accomplished by allowing air that usually leaks around surface seals to enter the blast area, normally from the trailing wall of the apparatus, in such a way that the abrasive particles do not escape. There is a constant spatter of abrasive particles at the point where the blast stream of abrasive particles strikes and deflects from the structure surface. An abrasive particle collision on or about the surface level at a sharp angle can cause the abrasive particles to project forcefully and abruptly in different directions. If an opening is located in the apparatus where abrasive particles can project, by deflection or directly, to the outside, these misdirected abrasive particles will escape at high speed, causing damage to machinery and constituting a danger to personnel in the immediate area. The apparatus of this invention facilitates entry of air, at least at the trailing wall of the blast head, after being forced at high speed across a given structure surface area, without the danger presented by escaping particulate. Upon entry into the apparatus, air velocity sweeps through the machine and only a small percentage of abrasive particles becomes wedged in crevices where the blast head contacts the treated surface.

The improvement of this invention includes carefully forming a passageway or corridor in which the lower containment structure constitutes the treated structure surface area behind the blasting area and an upper wall that is adjustable in order to vary the internal air intake area, and therefore the velocity, of the upwardly deflected abrasive particles at a selected air flow. A pair of spaced floating deflector seals contact and seal at the structure surface. A third side or wall is supplied with fixed resilient seal and a fourth, or trailing wall is open to the atmosphere for the intake of air. This corridor defines a passageway in which air is forced, either longitudinally or transversely, but in either case horizontally, across the structure surface immediately behind the blast travel area, in order to entrain loose abrasive and debris particles. This horizontal air flow has adequate force at structure surface level to entrain any loose particles lying there and convey the abrasive and debris particles through a labyrinth-type passageway or corridor. The corridor is constructed in such a way as to make it virtually impossible for any of the particles to escape the blast area under the force of retained kinetic energy.

Another improvement includes at least one drum journalled for rotation with respect to the carrying vehicle and tilted with respect to the horizontal, a fine screen defining the outside cylindrical surface of the drum, a coarse screen defining an inside cylindrical surface of the drums in spaced, concentric relationship with respect to the fine screen, a screen broom located in contact with the fine screen for cleaning purposes, and at least one paddle or blade and cone mounted in the drum at a transverse drum wall having an opening at the central axis. The drum receives abrasive particles, particulate aggregate and dust which rebound from the treated surface and are entrained in the incoming air stream and separates these components.

2. Description of the Prior Art

In existing surface treating machines utilizing an abrasive propulsion device, the abrasive is hurled toward the surface to be treated and after striking the structure surface, the abrasive deflects at an angle. In smaller machinery, the rebounding kinetic energy is usually sufficient to transfer the abrasive particles to a point above the abrasive propulsion device, therefore completing a cleaning cycle with no further (or very little) input of energy necessary to recycle the abrasive particles.

A problem exists when this technique is operated on soft or irregular surfaces where most of the kinetic energy in such an operation is absorbed or misdirected, since there is insufficient abrasive rebound to complete the recovery and redirection cycle. Another problem exists when the machine is sufficiently large to require that the rebounding abrasive particles reach a higher level than would normally be necessary in smaller machines. There is only a finite quantity of kinetic energy storage possible in an abrasive particle and this energy varies according to the size of the abrasive particle and the angle at which it strikes the structure surface. The larger the particle and the less the angle at which it strikes the structure surface, the higher the level of kinetic energy retained.

When an abrasive is used that is sufficiently small to provide good cleaning area coverage and when this abrasive is propelled toward the horizontal structure surface at any angle that would facilitate a productive amount of work, there is usually not an adequate amount of energy left in the abrasive particle to reach a very high level in the recovery mechanism. In the past, machines which needed a higher elevation of spent abrasive particles relied on magnets, rotary brooms, bucket elevators and the like, to lift particles beyond the rebound energy boundary.

There are various devices known in the art for abrading road and other horizontal structure surfaces for the purpose of texturing and cleaning the surfaces. In each case, the accepted technique includes forcing the abrasive particles at the structure surface to be textured or cleaned in angular relationship and utilizing various techniques, including abrasive rebound energy, to recycle the particles back to the abrasive propulsion device or devices. In addition to the rebounding energy mechanism, other techniques such as magnets, rotary brooms, mechanical conveyors and elevators, as well as induced air currents with entry points at or above structure surface levels, have been used with varying degrees of success, to recover and recycle the abrasive particles. One problem which has become apparent regarding machines which depend mostly on rebound for abrasive recycling, is the lost kinetic energy of the abrasive particles after they strike the structure surface to be abraded. This energy loss causes the particles to drop back onto the structure surface, where they accumulate and are lost from the recycle process. If this condition becomes sufficiently pronounced to form a multiple layer of abrasive on the surface to be abraded, additional abrasive propelled onto this accumulated layer will lose virtually all kinetic energy upon contact with the layer due to absorption, thereby compounding the rebounding problem. Under these conditions, total evacuation of the abrasive supply hopper in the machine soon occurs and the accumulation of abrasive particles must then be recovered from the structure surface, usually by manual labor, using brooms, shovels and buckets to reload the hopper, thus necessitating costly machine downtime.

In my U.S. Pat. No. 4,433,511, dated Feb. 28, 1984, entitled "Mobile Abrasive Blasting Surface Treating Apparatus", I detail a mobile apparatus for treating structure surfaces by abrasive blasting. The apparatus includes a mobile housing with self-propelled, endless tracks for traversing the surface to be treated. The housing includes a reservoir for containing abrasive particles and a rotary wheel with blades that rotate to propel the abrasive particles against the surface to be treated in angular relationship and abrade or etch the surface. A return passage for the particles has an opening at the angle of rebound of the particles extending toward the reservoir and multiple trays receive the recirculating particles and fill with particulate material, which material then spills into the reservoir. Particulate material on the trays absorbs the kinetic energy from the following or trailing particles to prevent further rebounding. The particles spill from the trays in a stream or sheet, intersected by a stream of air and trays separate the more coarse particulate debris from the abrasive particles en route back to the reservoir. Dust collectors are provided to separate the dust from the air used in separating coarse debris from the abrasive particles and from the air flow, to assist in sweeping debris from beneath the apparatus.

Typical of the abrading devices known in the prior art are those detailed in the following U.S. Pat. No. 1,954,111, dated Apr. 10, 1934, to J. Wilkes, entitled "Machine for Abrading Concrete Surfaces"; U.S. Pat. No. 3,858,359, dated Jan. 7, 1975, to Raymond M. Leiliart, entitled "Mobile Surface Treating Apparatus"; U.S. Pat. No. 3,877,175, dated Apr. 15, 1975, to Clyde A. Snyder, entitled "Mobile Surface Treating Apparatus"; U.S. Pat. No. 3,906,673, dated Sep. 23, 1975, to T. Goto, et al, entitled "Abrasive Cleaning Machine"; U.S. Pat. No. 3,934,373, dated Jan. 27, 1976, to Raymond M. Leiliart, entitled "Portable Surface Treating Apparatus"; U.S. Pat. No. 3,977,128, dated Aug. 31, 1976, to James R. Goff, entitled "Surface Treating Apparatus"; U.S. Pat. No. 4,080,760, dated Mar. 28, 1978, to Raymond Leiliart, entitled "Surface Treatment Device Including Magnetic Shot Separator"; U.S. Pat. No. 4,052,820, dated Oct. 11, 1977, to John C. Bergh, entitled "Portable Surface Treating Apparatus"; U.S. Pat. No. 4,336,671, dated Jun. 29, 1982, to Robert T. Nelson, entitled "Surface Cleaning Apparatus"; U.S. Pat. No. 4,364,823, dated Dec. 21, 1982, entitled "Apparatus for Separating Abrasive Blasting Media from Debris"; U.S. Pat. No. 4,376,358, dated Mar. 15, 1983, to John J. Shelton, entitled "Surface Treating Apparatus"; U.S. Pat. No. 4,377,922, dated Mar. 29, 1983, to John C. Bergh, entitled "Portable Apparatus for Treating Surfaces"; U.S. Pat. No. 4,377,923, dated Mar. 29, 1983, to John C. Bergh, entitled "Surface Treating Apparatus"; U.S. Pat. No. 4,377,924, dated Mar. 29, 1983, to John C. Bergh, entitled "Portable Device for Treating Surfaces"; U.S. Pat. No. 4,382,352, dated May 10, 1983, to Robert T. Nelson, entitled "Apparatus for Cleaning Surfaces, Including Means for Separating Debris and Abrasive Material"; U.S. Pat. No. 4,394,256, dated Jul. 19, 1983, to James R. Goff, entitled "Apparatus for Separating Abrasive Blasting Media from Debris"; U.S. Pat. No. 4,406,092, dated Sep. 27, 1983, entitled "Surface Cleaning Machine"; U.S. Pat. No. 4,416,092, dated Nov. 22, 1983, entitled "Cleaning Apparatus"; U.S. Pat. No. 4,646,481, dated Mar. 3, 1987, to Wayne E. Dickson, entitled "Surface Blasting Apparatus"; and U.S. Pat. No. 4,693,041, dated Sep. 15, 1987, to Wayne E. Dickson, entitled "Surface Blasting Appartus".

It is an object of this invention to provide a new and improved controlled velocity air sweep system for sweeping abrasive, road debris and dust through a rotating drum separation system and circulating the abrasive back to one or more abrasive propulsion devices with minimum loss of abrasive.

Another object of the invention is to provide a velocity-adjustable air sweep system for a mobile road surface texturing apparatus, which system does not depend upon the rebound energy of the abrasive for separation and recirculation to the abrasive propulsion device or devices.

Yet another object of the invention is to provide an air sweep system for sweeping a treated surface of abrasive particles and road debris such as aggregate and dust and transferring the abrasive particles, road debris and dust to a new and improved rotating drum separation system for separation, where the abrasive particles are recycled for feeding to the abrasive propulsion device or devices.

SUMMARY OF THE INVENTION

These and other objects of the invention are provided in a new and improved controlled-velocity air sweep system for sweeping a treated surface clear of abrasive particles, road debris such as aggregate and dust and like material through a conveyor system to one or more dual screen rotating drum separators, where the abrasive is separated from the aggregate and dust and recycled for feeding to one or more abrasive propulsion devices and repeated impingement on the treated surface.

BRIEF DESCRIPTION OF THE DRAWINGS

The invention will be better understood by reference to the accompanying drawings, therein.

DESCRIPTION OF THE PREFERRED EMBODIMENTS

Figure 1:
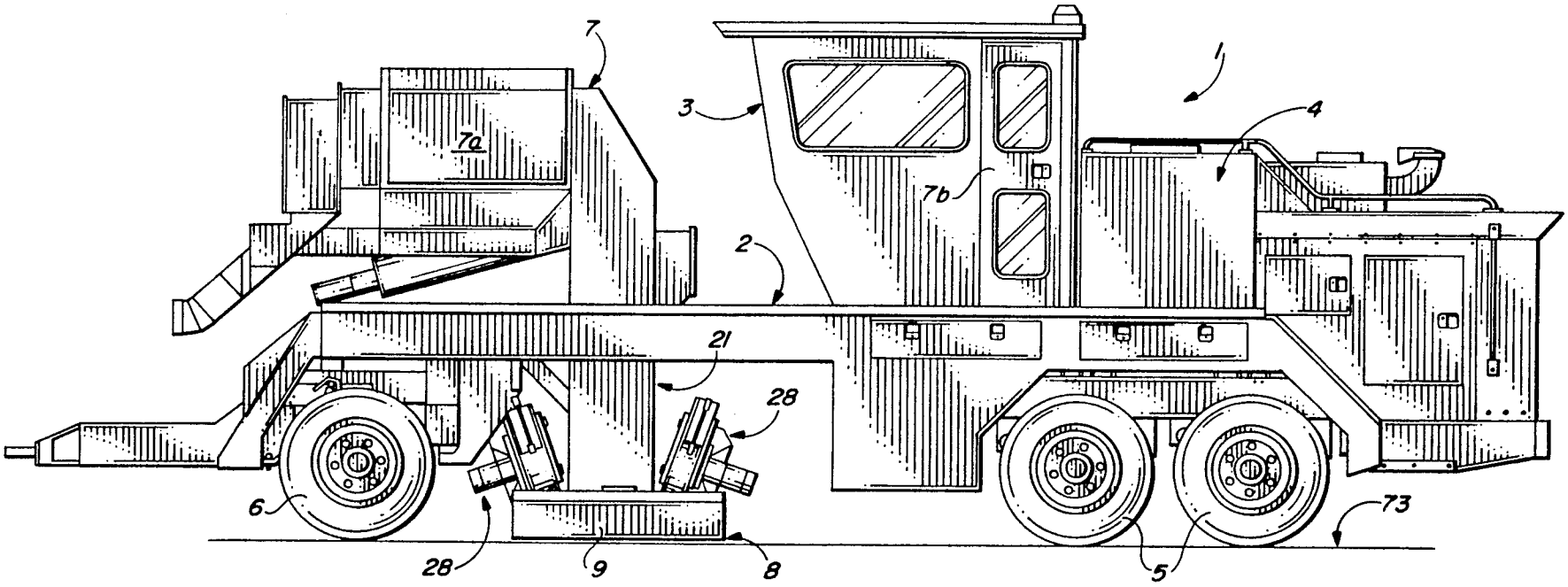
FIG. 1 Is a side view of a typical mobile road surface texturing apparatus utilizing the air sweep system of this invention.

Referring initially to FIG. 1 of the drawings, the mobile road surface texturing apparatus of this invention is generally illustrated by reference numeral 1. The mobile road surface texturing apparatus 1 is characterized by a frame 2, fitted with a cab 3, provided with cab doors 7*b*, an engine compartment 4, rear wheels 5 and front wheels 6 for traversing a horizontal structure surface 73, such as a road, highway or airport runway. A pair of blast heads 21 (one of which is illustrated) project downwardly from the frame 2 forwardly of the cab 3 and rearwardly of the front wheel 6 and each include at least one oppositely-disposed abrasive propulsion device 28 (one pair of which is illustrated), mounted between a pair of parallel sweeper side plates 9, in each blast head 21. Each blast head 21 is also coupled to an abrasive separation system 7, projecting above the frame 2 forward of the cab 3, as illustrated.

Figure 2:
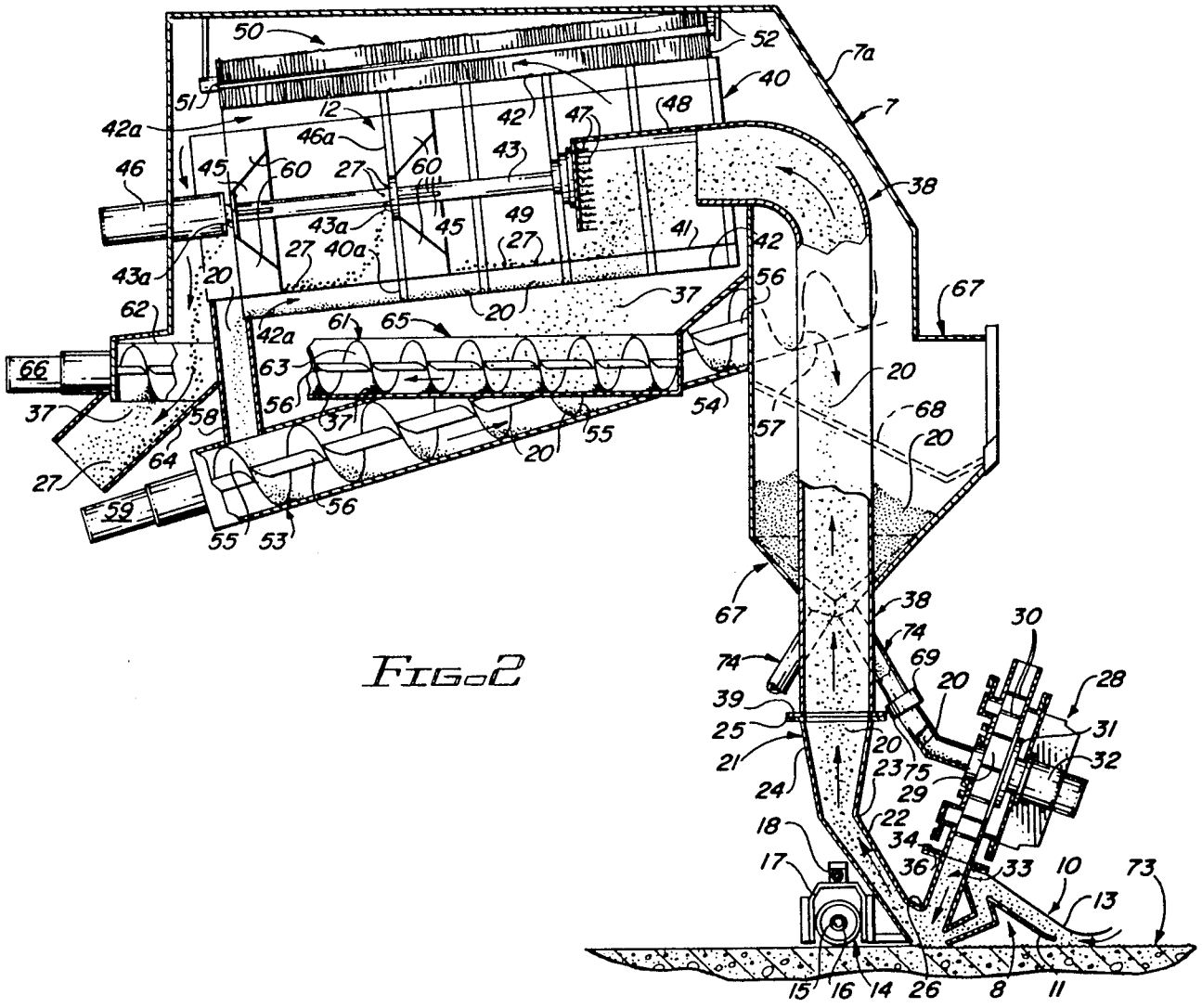
FIG. 2 is an enlarged side sectional view of an abrasive handling system having a single abrasive propulsion device for application in the mobile road surface texturing apparatus illustrated in FIG. 1.
Figure 3:
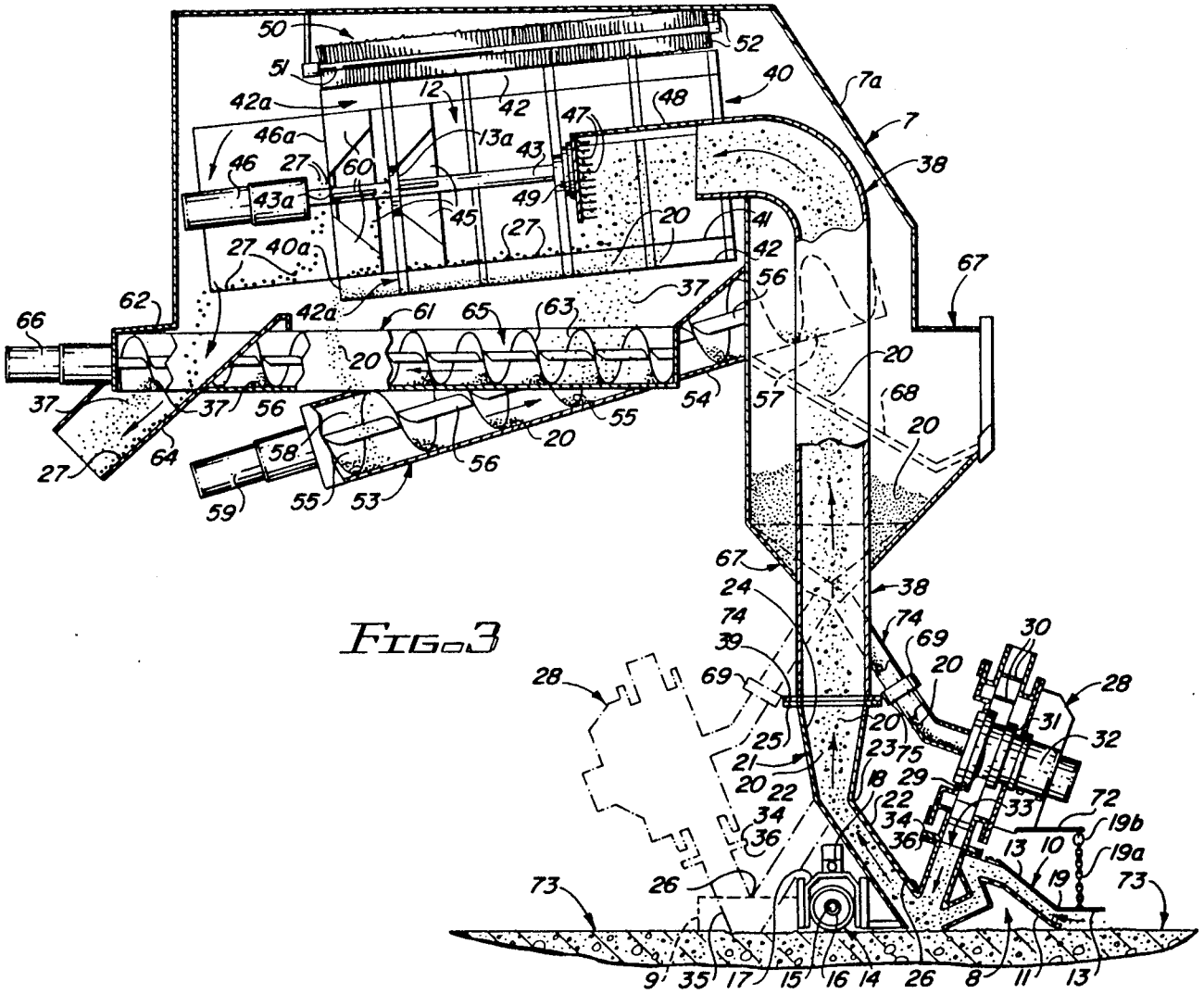
FIG. 3 is an enlarged side sectional view of an abrasive handling system having a pair of abrasive propulsion devices.

Referring now to FIGS. 1-3 and 6 of the drawings, the blast head(s) 21 are fitted with an air sweeper assembly 8, bounded by the parallel, spaced abrasive side plates 9, which define the sides of an air-receiving sweeper channel 10, further defined by a resilient leg 11 and a channel plate 13, as further illustated in FIGS. 1-3. A hinge 19 is provided in the channel plate 13 illustrated in FIG. 3, such that a leading edge of the channel plate 13 is adjustably located above the horizontal structure surface 73, which is subjected to texturing and abrading by the mobile road surface texturing apparatus 1. The leading edge of the channel plate 13 can therefore be adjusted to open or close the air entry duct or passage defined by the abrasive side plates 9, resilient leg 11 and hinged channel plate 13. This adjustment is effected by means of an adjusting chain 19*a* and a connecting turnbuckle 19*b*, attached to a support bracket 72, as further illustrated in FIG. 3. A roller 14 is journalled for rotation in the blast head(s) 21 by means of roller shaft bolts 15, cooperating roller bearings 16 and bearing supports 17, as further illustrated in FIG. 3. A resilient shock absorber 18 is located at the top of the bearing support 17 to absorb the shock when the air sweeper assembly 8 and blast head(s) 21 traverse the horizontal structure surface 73 by operation of the roller 14. Each blast head 21 further includes a rebound leg 22, which extends downwardly in angular relationship in inverted Y-fashion from a corresponding rebound neck 23 to a mirror angle 26, as further illustrated in FIG. 3. Each rebound leg 22 then extends upwardly at approximately the mirror angle 26 from a discharge extension flange 36, which mounts on the wheel discharge flange 34 of the wheel discharge 33 of corresponding abrasive propulsion device(s) 28, which are oriented in angular relationship with respect to the horizontal structure surface 73. Each of the abrasive propulsion devices 28 is fitted with a rotating wheel 29, having wheel blades 30, a wheel hub 31 and a hydraulic wheel motor 32, connected to the wheel hub 31, for driving the rotating wheel 29 at a preselected rotational speed. The wheel discharge 33 is provided with a wheel discharge flange 34, which matches the corresponding discharge extension flange 36 located in each rebound leg 22. Accordingly, when the rotating wheels 29 are operating, abrasive 20, such as steel shot, is fed through the feed conduit(s) 74 into the center of the rotating wheels 29 and is discharged at high velocity at each wheel discharge 33 through the respective rebound legs 22 onto the horizontal structure surface 73. The abrasive 20 rebounds from the horizontal surface 73 into the respective rebound legs 22, at the approximate mirror angle 26, as hereinafter further described. A collection leg 24 (one of which is illustrated) extends upwardly from the rebound neck 23 element of each blast head 21 and terminates at a collection leg flange 25, which is connected to a cooperating tube flange 39, terminating the bottom end of a corresponding upward-standing vertical abrasive conveyor 38. The abrasive 20 is mixed with gravel or aggregate 27 and dust 37, as well as other debris such as road chips and the like, in the upwardly-directed air stream, as illustrated in FIGS. 2 and 3 and these materials must be separated in order to recycle and reuse the abrasive 20, as further hereinafter described.

Referring now to FIGS. 1-3 and 5 of the drawings, in the case of twin sets of abrasive propulsion devices 28, the abrasive separation system 7 is designed to receive the abrasive 20, aggregate 27 and dust 37 which are channeled through the twin vertical abrasive conveyors 38, from the respective blast heads 21. This material enters a pair of parallel, slightly downwardly-tilting, concentric rotating screen drums 40 (one of which is illustrated), each of which includes a fine screen 42, extending around the periphery of the screen drum 40 and a course screen 41, located inside the fine screen 42 in spaced relationship, to define an annular cylindrical space 42*a*. The discharge ends of the twin vertical abrasive conveyors 38 are sealed in the inlet ends of the respective screen drums 40 to prevent loss of abrasive 20, aggregate 27 and dust 37. A pair of screen brooms 50 are mounted in the screen cabinets 7*a*, illustrated in FIG. 1 and enclose the screen drums 40, respectively, and each include a broom shaft 51, fitted with multiple broom bristles 52, which contact and continually clean the fine screen 42. The abrasive 20, aggregate 27, and dust 37 enter the screen drums 40 at one end and strike multiple arresting shelves 47, illustrated in FIGS. 2 and 3, which are aligned in vertically-spaced relationship and are attached to a shelf bracket 49, provided on the extending end of a screen shaft 43, as the air diffuses from the rotating screen drums 40. A shelf plate 48 projects from the top one of the arresting shelves 47 to the mouth of each vertical abrasive conveyor 38, in order to prevent the abrasive 20, aggregate 27 and dust 37 from flowing upwardly in the screen drums 40 with the air stream. The opposite end of each screen shaft 43 is secured to a screen shaft motor 46 and the dual fixed cones 45 direct air outwardly from the mouth of each vertical abrasive conveyor 38, through the coarse screens 41 and the fine screens 42, respectively, while the abrasive 20, aggregate 27 and dust 37 fall downwardly by operation of gravity to the coarse screens 41 and the fine screens 42, respectively, as illustrated in FIGS. 2 and 3. Two sets of paddles or blades 60 are spaced by an expansion chamber 12 and are built into the lower forward end of the coarse screen 41 and extend radially from the screen shaft 43, behind the respective fixed cones 45. The blades 60 are designed to engage and transport trapped aggregate 27 which collect at the ends of the screen drums 40 on the coarse screen 41 as the screen drums 40 rotate and transport the aggregate through the respective shaft openings 43*a*, at the center of the blades 60, as further illustrated in FIGS. 2 and 3. The aggregate 27 migrates through the shaft openings 43*a*, forwardly to the ends of the screen drums 40 due to the rotation of the downwardly-tilted screen drums 40, for engagement by the respective blades 60. The aggregate 27 is, in turn, rotated by the blades 60, discharged from additional openings (not illustrated) located in the forward end of the screen drums 40 and collected in a pair of dust conveyor discharges 64, along with the dust 37, which filters downwardly through both the coarse screens 41 and the fine screens 42 and deposits in the twin dust conveyors 61, as illustrated in FIGS. 2 and 3. The dust conveyors 61 are each located beneath a separate one of the screen drums 40 and above the twin dust conveyor discharges 64, and are characterized by an open-top, cylindrical dust conveyor housing 62, having a dust conveyor feed opening 65, and receives a rotating dust conveyor screw 63, driven by a dust conveyor motor 66, to move the accumulated dust 37 into the dust conveyor discharges 64, where it is mixed with the aggregate 27, as further illustrated in FIG. 3. A vacuum system (not illustrated) is connected to the dust conveyor discharges 64 to cause the flow of air into the sweeper channel 10, through the blast heads 21 and upwardly through the vertical abrasive conveyors 38, as described above.

Referring again to FIGS. 2 and 3, the respective blades 60 may be spaced varying distances by the expansion chamber 12. Accordingly, as illustrated, the blades 60 are spaced a considerable distance from each other and the expansion chamber 12 is quite large in FIG. 2, while the blades 60 are closer and the expansion chamber smaller in FIG. 3. Variable spacing of the blades 60 has been found to separate the abrasive 20, aggregate 27 and dust 37 in an optimum manner, depending upon the surface conditions encountered and the volume of material to be separated.

Figure 4:
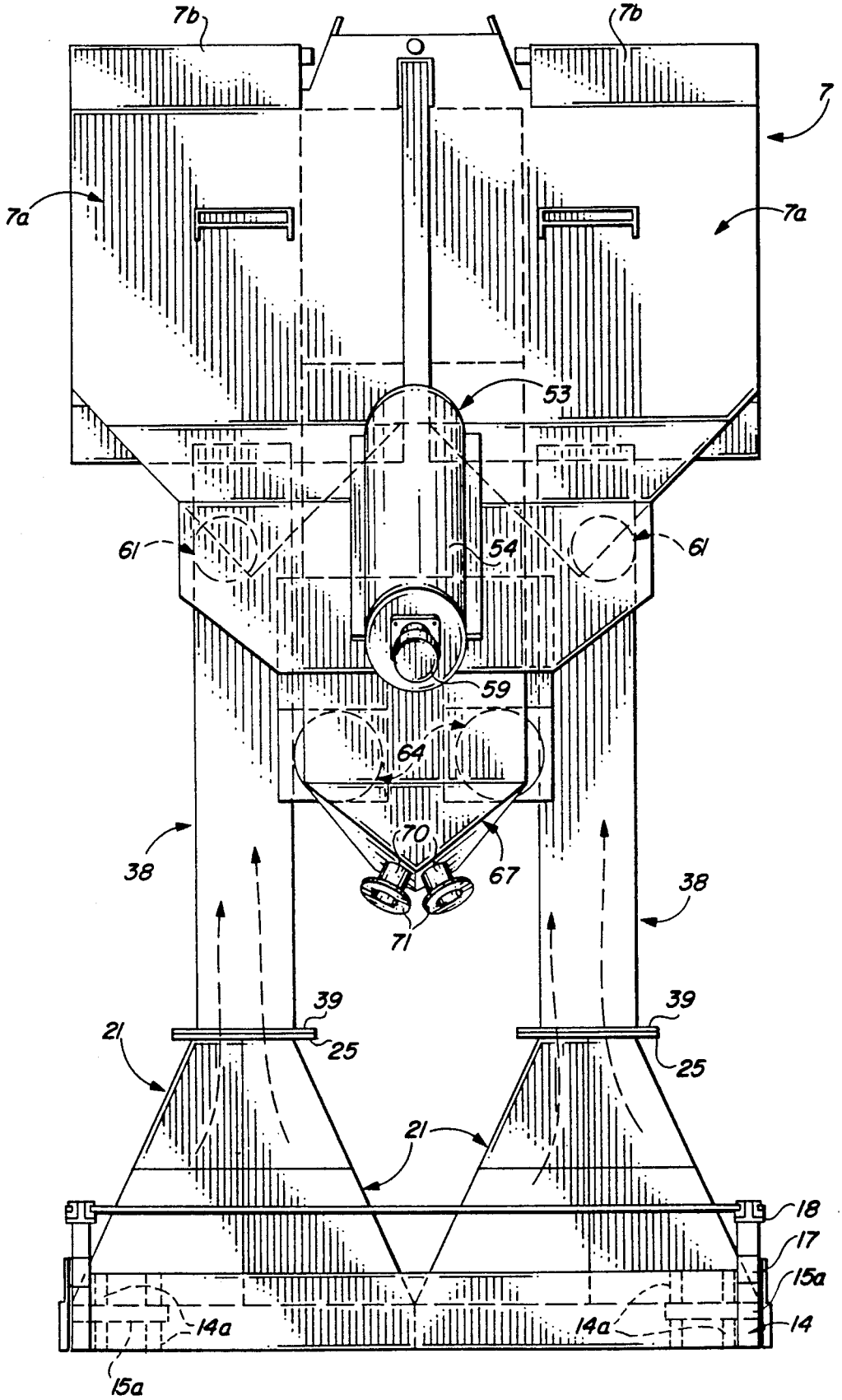
FIG. 4 is a front view of the blast head, sweeper channel and vertical abrasive conveyor components of the mobile road surface texturing apparatus illustrated in FIGS. 1-3.
Figure 5:
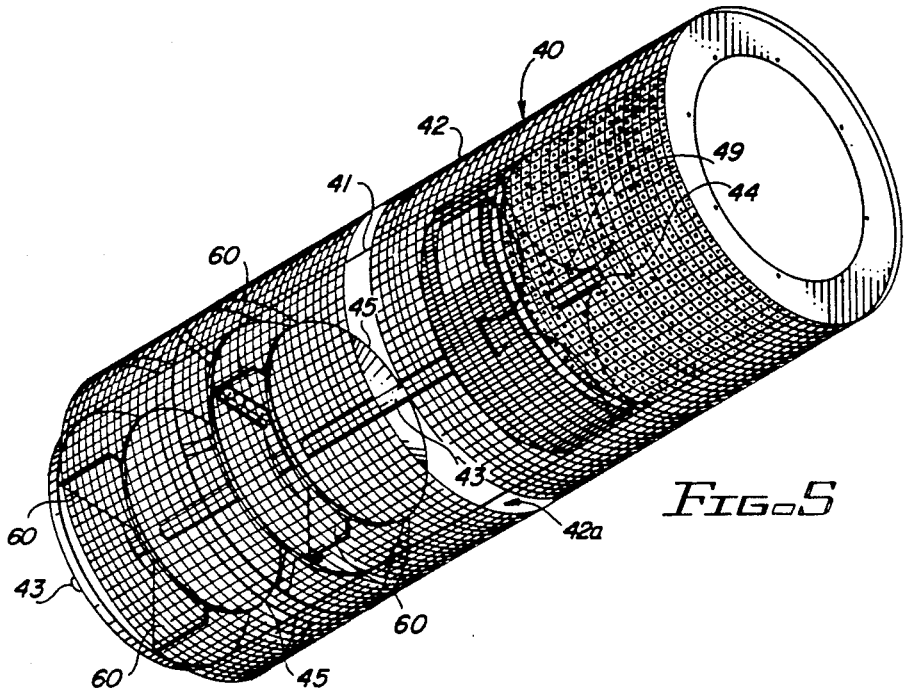
FIG. 5 is a perspective view of a dual screen and drum for separating abrasive, aggregate and dust from the incoming air stream.
Figure 6:
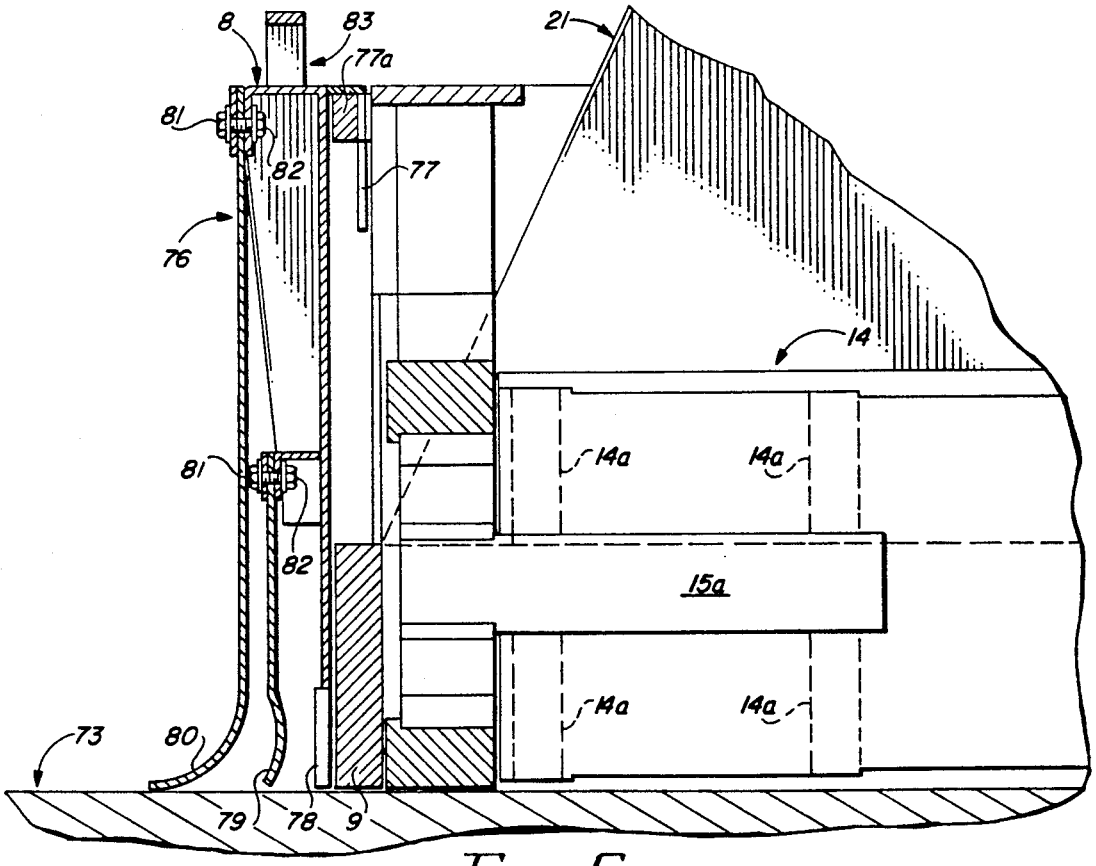
FIG. 6 is an enlarged front view of the lower segment of the blast head and sweeper channel elements of the abrasive handling system, more particularly illustrating preferred sealing components.

The abrasive 20 is typically characterized by steel shot which is sufficiently small to traverse the mesh of the coarse screens 41, but too large to pass through the mesh of the fine screens 42. Accordingly, the abrasive 20 is trapped in the annular space 42*a* between the coarse screens 41 and the fine screens 42 in the screen drums 40, respectively, and migrates by rotation of the screen drums 40 through an opening (not illustrated) at the outer periphery of each forward drum plate 40*a*, into an abrasive conveyor feed 58, as illustrated in FIG. 4. From the abrasive conveyor feed 58, the abrasive 20 drops into one end of a downwardly-tilted abrasive conveyor 53, which is characterized by a cylindrical abrasive conveyor housing 54 and an abrasive conveyor screw 55, mounted on a screw shaft 56, driven by the abrasive conveyor motor 59 and enclosed by the abrasive conveyor housing 54. In a most preferred embodiment of the invention the abrasive conveyor 53 is canted forwardly and downwardly with respect to the screen cabinet 7*a*, illustrated in FIG. 1, and the abrasive 20 is slowly forced upwardly and rearwardly along the incline by operation of the abrasive conveyor screw 55 to the abrasive conveyor discharge 57, where the abrasive 20 drops by operation of gravity into the mouth of the hopper 67. A hopper sieve plate 68 is located in the hopper 67 to trap any oversized foreign bodies. The abrasive 20 then drops through properly sized openings in the hopper sieve plate 68 directly into the hopper 67, where it is held for sequential distribution to the respective oppositely-disposed abrasive propulsion device or devices 28, through the corresponding feed conduits 74, as illustrated in FIG. 2.

Referring again to FIGS. 2, 3 and 4 of the drawings, in a most preferred embodiment of the invention a pair of feed tube nipples 70 are welded or otherwise attached to the bottom of the hopper 67, in order to locate and secure the feed conduits 74 between the respective abrasive propulsion devices 28 and the hopper 67. Accordingly, the abrasive 20 is allowed to flow freely in a steady stream from the hopper 67 to metering valves 69, illustrated in FIGS. 2 and 3, through each of the feed conduits 74 into the respective abrasive propulsion devices 28, to facilitate a continuous, high velocity spatter of abrasive 20 against the horizontal structure surface 73 at a contact and rebound area and recycling in sequence through the blast heads 21, the vertical abrasive conveyors 38 and the abrasive separation system 7, back into the hopper 67.

As illustrated in FIGS. 2, 3, 4 and 6 of the drawings, in a preferred embodiment of the invention the blast heads 21 are sealed at the abrasive side plates 9 against the horizontal structure surface 73 by a pair of spaced floating deflector seals 76, which "float" with respect to the blast heads 21 by means of a stay plate 77, removably mounted on a plate mount 77*a*. A separate seal plate 78, resilient seal 79 and flexible seal flap 80 effect this seal, wherein the flexible seal flap 80 and resilient seal 79 are attached to the seal plate 78 by means of bolts 81 and nuts 82, respectively. A handle 83 is provided on each of the seal plates 78 for handling the respective floating deflector seals 76.

Referring again to the drawings, the mobile road surface texturing apparatus 1 operates as follows. Referring initially to FIGS. 1–3, air is caused to circulate from the atmosphere through the sweeper channel 10 located in the air sweeper assembly 8 in the direction of the arrows, as illustrated in FIGS. 2 and 3, by operating a vacuum system (not illustrated) connected to the dust conveyor discharges 64. In the non-adjustable version of the sweeper channel 10 illustrated in FIG. 2, adjustment of the incoming air velocity must be effected by operation of the vacuum apparatus (not illustrated). However, in the adjustable version of the sweeper channel 10 illustrated in FIG. 3, the velocity of the incoming air can also be adjusted in the sweeper channel 10 by adjusting the size of the air passage. This is accomplished by manipulating the turnbuckle 19*b* to open or close the channel plate 13 on the hinge 19. In both cases, this air is channeled from the sweeper channel 10 upwardly through the rebound legs 22 of the respective blast heads 21 which are closest to the sweeper channel 10, and through the corresponding twin vertical abrasive conveyors 38, into the parallel screen drums 40 and from the screen drums 40 through the twin dust conveyor discharges 64. Abrasive 20 which rebounds from the horizontal structure surface 73 into the oppositely-disposed rebound legs 22 located farthest from the sweeper channel 10 joins the abrasive 20, aggregate 27 and dust 37 from the other rebound legs 22 at the rebound neck 23 and the combined composite of abrasive 20, aggregate 27 and dust 37 is swept by the air stream into the twin vertical abrasive conveyors 38, as hereinafter further described. The abrasive 20, which may be steel shot or the like, is fed from the hopper 67, through metering valves 69 and through each of the feed conduits 74 to the centers of the respective rotating wheels 29 of the oppositely-disposed sets of abrasive propulsion devices 28, where the abrasive 20 is forced from each wheel discharge 33 of the rotating wheels 29 at high velocity against the horizontal structure surface 73, as further illustrated by the arrows in FIGS. 2 and 3. Since the abrasive 20 is directed against the horizontal structure surface 73 at an angle which corresponds approximately to the mirror angle 26, the abrasive 20 rebounds into the respective rebound legs 22 and the rebound energy of the abrasive 20 allows the abrasive 20 to reach or approach the rebound neck 23. At this point, the air sweeping across the horizontal structure surface 73 in the blast heads 21 and circulating upwardly through the rebound legs 22 and into the vertical abrasive conveyors 38, counteracts the pull of gravity on the abrasive 20, as well as the dust 37 and gravel 27 mixed with the abrasive 20, and causes the mixture to move upwardly through the vertical abrasive conveyors 38 into the screen drums 40. However, it is understood that regardless of the rebound height of the abrasive 20 with the vertical abrasive conveyors 38, the air velocity through the sweeper channel 10 can be adjusted as described above to sweep the abrasive 20 through the vertical abrasive conveyors 38 and screen drum 40. Movement of the mobile road surface texturing apparatus 1 in the direction of the arrow illustrated in the drawings effects a continuous sweeping of the horizontal structure surface 73 and the air stream picks up any loose abrasive 20 which does not rebound with sufficient energy into the respective rebound legs 22. After reaching the screen drums 40, the air diffuses from the screen drums 40 and the mixture then contacts the arresting shelves 47, the cones 45 and the respective coarse screens 41, which coarse screens 41 separate the larger aggregate 27 from the abrasive 20, dust 37 and smaller aggregate 27. The abrasive 20 is collected on the respective fine screens 42 and is channeled from the screen drums 40 into the abrasive conveyor feed 58 and ultimately, into the abrasive conveyor 53 and back into the hopper 67, where it is again channeled to the abrasive propulsion devices 28 to complete the abrading cycle, as heretofore described. The aggregate 27 and dust 37 are collected by means of the coarse screens 41 and a dust conveyor 61, respectively, into the dust conveyor discharge 64, for transfer to a truck or other collection vehicle, for later disposal.

It will be appreciated by those skilled in the art that an important preferred characteristic of the mobile road surface texturing apparatus 1 of this invention is the provision of at least one, and preferably a pair, of vertical abrasive conveyors 38 which receive a constant flow of air from the blast head(s) 21, which air flow is sufficiently strong by adjustment at the sweeper channels 10 to counteract the gravitational effect on, and prevent the rebounding abrasive 20, aggregate 27 and dust 37, respectively, from falling back into the blast heads 21, respectively. This is important, since the kinetic energy of the abrasive 20, aggregate 27 and dust 37 upon rebound is not sufficient to carry this material upwardly along the entire length of the vertical abrasive conveyor(s) 38 into the rotating screen drum(s) 40. Indeed, the improved mobile road surface texturing apparatus 1 of this invention does not depend or rely upon rebound energy alone for this transportation and recycle of the abrasive 20, since the incoming air stream may be adjusted until it is sufficiently strong to carry the abrasive 20, aggregate 27 and dust 37 in a continuous flow to the abrasive separation sytem 7 as illustrated in FIGS. 2 and 3 where the air stream delivers the abrasive 20, aggregate 27 and dust 37 to the screen drums 40. Furthermore, it is understood that although a single sweeper channel has been illustrated in the drawings at the rear of the blast head(s) 21, a second sweeper channel (not illustrated) can be added to the front of the blast head(s) 21, as deemed necessary to further sweep abrasive 20 from the horizontal structure surface 73.

It will be further appreciated by those skilled in the art that the mobile road surface texturizing apparatus of this invention is designed to texture road surfaces and other horizontal structure surfaces to a desired extent utilizing a spherical steel abrasive to produce a six foot wide swath in a single operation. The device operates to clean and texture a road or other horizontal surface without danger of subsurface fracture and the textured depth can be controlled on asphalt, concrete and polymer pavement. It also operates free of dry dust and requires no clean-up. Furthermore, a very high percentage of abrasive is recycled from impingement on the road surface, with very little abrasive loss and accompanying downtime. This minimal abrasive residue is apparent because the mobile road surface texturing apparatus moves in the direction of the arrows, as illustrated in FIGS. 1, 3 and 4 and the sweeping of the air flowing through the sweeper channel 10 and the corresponding blast heads 21 collects residual abrasive 20 which is expelled from the opposite abrasive propulsion device(s) 28 and may fail to rebound to the rebound neck 23 through the rebound legs 22 which are not swept by the air stream.

It will be appreciated that while a dual pair of oppositely-disposed abrasive propulsion devices 28 is illustrated in the mobile road surface texturing apparatus 1, along with twin vertical abrasive conveyors 38 and dual screen drums 40, more or less than two such sets of abrasive propulsion devices 28 and more or less than two vertical abrasive conveyors 38 and screen drums 40 may be incorporated, according to the teachings of this invention. Moreover, it is understood that the sweeper channel 10 may be located at any point in the air sweeper assembly 8 in order to effect the required sweeping of air across the interior of the blast heads 21, as desired.

Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. In a mobile road texturing apparatus characterized by a vehicle for movement over a surface to be treated, a reservoir provided in said vehicle for containing abrasive particles and at least one abrasive inlet connected to said reservoir, at least one pair of propulsion devices connected to said abrasive inlet for receiving abrasive particles from said reservoir and directing the abrasive particles at high velocity against the surface and at least one separator carried by said vehicle and receiving abrasive particles, duct and particulate debris and separating the abrasive particles from the dust and particulate debris and returning the abrasive particles to the reservoir, the improvement comprising at least one sweeper channel meant characterized by a channel plate carried by said vehicle, a hinge provided in said channel plate to define a fixed portion and a movable portion of said channel plate, adjusting means connected to said movable portion of said channel plate and said vehicle for raising and lowering said movable portion of said channel plate and a resilient leg spaced from said channel plate and carried by said vehicle, for receiving air at sufficient energy to overcome the terminal velocities of substantially all of the abrasive particles, dust and particulate debris expelled by said abrasive propulsion device and delivering said abrasive particles, dust and particulate debris to said separator.

2. The mobile road texturing apparatus of claim 1 further comprising at least one conveyor means provided in said vehicle between said sweeper channel means and said separator for receiving the air, abrasive particles and dust and particulate debris and channeling the air, abrasive particles, dust and particulate debris to said separator.

3. The mobile road texturing apparatus of claim 1 further comprising at least one blast head means carried by said vehicle and receiving said abrasive propulsion devices and said sweeper channel means.

4. The mobile road texturing apparatus of claim 1 further comprising:

(a) at least one conveyor means provided in said vehicle and connecting said sweeper channel means and said separator for receiving the air, abrasive particles and dust and particulate debris and channeling the air, abrasive particles, dust and particulate debris to said separator; and (b) at least one blast head means carried by said vehicle and receiving said abrasive propulsion devices and said sweeper channel means.

5. The mobile road texturing apparatus of claim 1 further comprising adjusting means provided in said sweeper channel means for adjusting the size of said sweeper channel means and the velocity of air flowing through said sweeper channel means.

6. The mobile road texturing apparatus of claim 5 further comprising at least one conveyor means provided in said vehicle and connecting said sweeper channel means and said separator for receiving the air, abrasive particles and dust and particulate debris and channeling the air, abrasive particles, dust and particulate debris to said separator.

7. The mobile road texturing apparatus of claim 5 further comprising at least one blast head means carried by said vehicle and receiving said abrasive propulsion devices and said sweeper channel means.

8. The mobile road texturing apparatus of claim 5 further comprising:

(a) at least one conveyor means provided in said vehicle and connecting said sweeper channel means and said separator for receiving the air, abrasive particles and dust and particulate debris and channeling the air, abrasive particles, dust and particulate debris to said separator; and (b) at least one blast head means carried by said vehicle and receiving said abrasive propulsion devices and said sweeper channel means.

9. In a mobile road texturing apparatus characterized by a vehicle for movement over a surface to be treated, a reservoir provided in said vehicle for containing abrasive particles and at least one abrasive inlet connected to said reservoir, at least one abrasive propulsion device connected to said abrasive inlet for receiving abrasive particles from said reservoir and directing the abrasive particles at high velocity against the surface and a sweeper channel carried by said vehicle for receiving air and channeling the air to the dust and particulate debris rebounding from the surface with the abrasive particles expelled by said abrasive propulsion device, the improvement comprising a separator drum having a center longitudinal axis and journalled for rotation along said center longitudinal axis, a fine screen defining the outside cylindrical surface of said separator drum and a coarse screen defining an inside cylindrical surface of said separator drum in spaced, concentric relationship with respect to said fine screen and at least one paddle means provided in said separator drum for contacting the abrasive particles and removing the abrasive particles from said separator drum.

10. The mobile road texturing apparatus of claim 9 further comprising first screw conveyor means disposed beneath said separator drum for receiving dust and particulate debris from said separator drum and delivering said dust and debris to a point of disposal and second screw conveyor means disposed beneath said separator drum for receiving abrasive particles expelled from said separator drum.

11. The mobile.. road texturing apparatus of claim 9 further comprising at least one conveyor means provided in said vehicle and connecting said sweeper channel and said separator drum for receiving the air, abrasive particles and dust and particulate debris and channeling the air, abrasive particles, dust and particulate debris to said separator drum.

12. The mobile road texturing apparatus of claim 9 further comprising:

(a) first screw conveyor means disposed beneath said separator drum for receiving dust and particulate debris from said separator drum and delivery said dust and debris to a point of disposal and second screw conveyor means disposed beneath said separator drum for receiving abrasive particles expelled from said separator drum., and (b) at least one conveyor means provided in said vehicle and connecting said sweeper channel and said separator drum for receiving the air, abrasive particles and dust and particulate debris and channeling the air, abrasive particles, dust and particulate debris to said separator drum.

13. The mobile road texturing apparatus of claim 9 further comprising at least one blast head means carried by said vehicle and receiving said abrasive propulsion device and said sweeper channel and screen broom means carried by said vehicle in close proximity to said separator drum for contacting and cleaning said fine screen.

14. The mobile road texturing apparatus of claim 9 further comprising:

(a) first screw conveyor means disposed beneath said separator drum for receiving dust and particulate debris from said separator drum and delivering said dust and debris to a point of disposal and second screw conveyor means disposed beneath said separator drum for receiving abrasive particles expelled from said separator drum;

(b) at least one conveyor means provided in said vehicle and connecting said sweeper channel and said separator drum for receiving the air, the abrasive particles and dust and particulate debris and channeling the air, abrasive particles, dust and particulate debris to said separator drum; and (c) at least one blast head means carried by said vehicle and receiving said abrasive propulsion device and said sweeper channel and screen broom means carried by said vehicle in close proximity to said separator drum for contacting and cleaning said fine screen.

15. In a mobile road texturing apparatus characterized by a vehicle for movement over a surface to be treated, a reservoir provided in said vehicle for containing abrasive particles and at least one abrasive inlet connected to said reservoir, at least one abrasive propulsion device connected to said abrasive inlet for receiving abrasive particles from said reservoir and directing the abrasive particles at high velocity against the surface at a contact and rebound area, the improvement in combination therewith comprising a separator drum having a center longitudinal axis and journalled for rotation along said center longitudinal axis, a fine screen defining the outside cylindrical surface of said drum and a coarse screen defining an inside cylindrical surface of said drum in spaced, concentric relationship with respect to said fine screen and a pair of paddle means provided in said drum in spaced relationship for contacting the abrasive particles and separating the abrasive particles from said separator drum, at least one sweeper channel carried by said vehicle for receiving air at sufficient energy to overcome the terminal velocities of substantially all of the dust and particulate debris rebounding from the surface at said contact and rebound area along with the abrasive particles expelled by said abrasive propulsion device and delivering said abrasive particles, dust and particulate debris to said separator drum and adjusting means provided in said sweeper channel for adjusting the size of said sweeper channel means and the velocity of air flowing through said sweeper channel means.

16. The mobile road texturing apparatus of claim 15 further comprising at least one tubular conveyor provided in said vehicle and connecting said sweeper channel and said separator drum for receiving the air, abrasive particles and dust and particulate debris and channeling the air, abrasive particles, dust and particulate debris to said separator drum.

17. The mobile road texturing apparatus of claim 15 further comprising at least one blast head carried by said vehicle and receiving said abrasive propulsion device and said sweeper channel and screen broom means carried by said vehicle in close proximity to said separator drum for contacting and cleaning said fine screen.

18. The mobile road texturing apparatus of claim 15 further comprising a first screw conveyor disposed beneath said separator drum for receiving dust and particulate debris from said separator drum and delivering said dust and debris to a point of disposal and a second screw conveyor disposed beneath said separator drum for receiving abrasive particles expelled from said separator drum.

19. The mobile road texturizing apparatus of claim 15 further comprising:

(a) a first screw conveyor disposed beneath said separator drum for receiving dust and particulate debris from said separator drum and delivering said dust and debris to a point of disposal and a second screw conveyor disposed beneath said separator drum for receiving abrasive particles expelled from said separator drum; and (b) at least one tubular conveyor provided in said vehicle between said sweeper channel and said separator drum for receiving the air, the abrasive particles and dust and particulate debris and channeling the air, abrasive particles, dust and particulate debris to said separator drum.

20. The mobile road texturizing apparatus of claim 19 further comprising at least one blast head means carried by said vehicle and receiving said abrasive propulsion device and said sweeper channel and screen broom means carried by said vehicle in close proximity to said separator drum for contacting and cleaning said fine screen.

* * * * *